US011453528B2

(12) United States Patent
Hirmer

(10) Patent No.: US 11,453,528 B2
(45) Date of Patent: Sep. 27, 2022

(54) MOUNTING RING FOR A TRANSPORT CONTAINER AND TRANSPORT CONTAINER

(71) Applicant: Infinex Holding GmbH, Haiterbach (DE)

(72) Inventor: Thomas Hirmer, Haiterbach (DE)

(73) Assignee: Infinex Holding GmbH, Haiterbach (DE)

( * ) Notice: Subject to any disclaimer, the term of this patent is extended or adjusted under 35 U.S.C. 154(b) by 146 days.

(21) Appl. No.: 16/893,496

(22) Filed: Jun. 5, 2020

(65) Prior Publication Data

US 2020/0391904 A1 Dec. 17, 2020

(30) Foreign Application Priority Data

Jun. 14, 2019 (DE) ..... 10 2019 116 227.0

(51) Int. Cl.
*B65D 21/08* (2006.01)
*B65D 19/18* (2006.01)

(52) U.S. Cl.
CPC ..... *B65D 19/18* (2013.01); *B65D 21/086* (2013.01); *B65D 2519/009* (2013.01); *B65D 2519/00069* (2013.01); *B65D 2519/00208* (2013.01)

(58) Field of Classification Search
CPC ..... B65D 19/00; B65D 19/02; B65D 19/06; B65D 19/18; B65D 19/38; B65D 19/08; B65D 19/12; B65D 19/14; B65D 19/20; B65D 21/086; B65D 21/08; B65D 21/083; B65D 2519/00502; B65D 2519/00507; B65D 2519/00547; B65D 2519/00577; B65D 2519/00582; B65D 2519/00587;
(Continued)

(56) References Cited

U.S. PATENT DOCUMENTS 5,829,595 A * 11/1998 Brown ..... B65D 19/0018 206/600
6,554,148 B1 * 4/2003 Fernandez ..... B65D 9/12 220/4.33
(Continued)

FOREIGN PATENT DOCUMENTS

DE 102004010237 A1 * 9/2005 ..... B65D 19/06
DE 10 2015 105 030 B3 3/2016
(Continued)

*Primary Examiner* — Don M Anderson
(74) *Attorney, Agent, or Firm* — Renner, Otto, Boisselle & Sklar, LLP

(57) ABSTRACT

The invention relates to a mounting ring for a transport container (11), which can be arranged between a base (12) and a lid (16) of the transport container, having at least two ring sections (18, 19) which form a closed mounting ring (14) having several side walls (15), wherein each ring section (18, 19) comprises at least one side wall section (23, 24, 31, 32), which in each case has an upper and lower front surface (33, 34), and a front edge (37) extends at the respective end of the ring section (18, 19) between the upper and lower front surface (33, 34), said front edge forming a connection point (22) with an opposite front edge (37) of an adjacent ring section (18, 19), wherein the opposite front edges (37) of the side wall sections (23, 24, 31, 32) of the ring sections (18, 19) are connected to a retaining profile (21) to form a common side wall (15).

15 Claims, 2 Drawing Sheets

Figure 1:
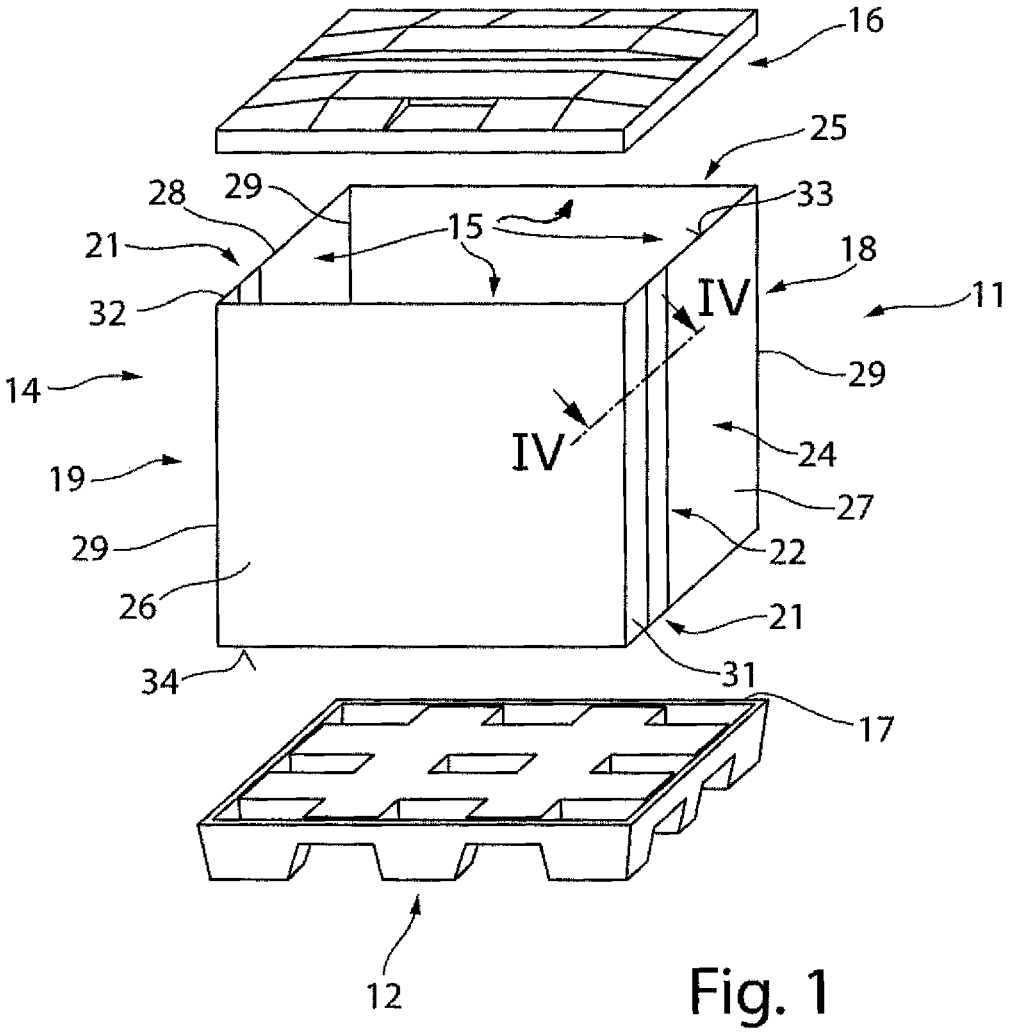

(58) Field of Classification Search
CPC ..... B65D 2519/00592; B65D 2519/00597; B65D 2519/00601; B65D 2519/00606; B65D 2519/00611; B65D 2519/00865; B65D 2519/00875; B65D 2519/0088; B65D 2519/00885; B65D 2519/00925; B65D 2519/00935; B65D 2519/0098; B65D 11/18; B65D 11/1846; B65D 11/1853; B65D 11/1866; B65D 11/1873; B65D 11/188; B65D 11/1886; B65D 2519/00069; B65D 2519/00208; B65D 2519/009; B65D 2519/00034; B65D 2519/00174; B65D 2519/00338; B65D 2519/00527; B65D 2519/00641; B65D 2519/00711; B65D 2519/0091; B65D 2519/00995
See application file for complete search history.

(56) References Cited

U.S. PATENT DOCUMENTS

| | | | | |
|---|---|---|---|---|
| 2005/0017000 | A1* | 1/2005 | Vergiels | B65D 19/20 220/4.28 |
| 2011/0132801 | A1* | 6/2011 | Elder | B65D 19/18 206/600 |
| 2013/0092685 | A1* | 4/2013 | Erm | B65D 9/14 220/6 |
| 2017/0029163 | A1* | 2/2017 | Olds | B65D 21/086 |
| 2017/0217633 | A1* | 8/2017 | Lundius | B65D 19/06 |

FOREIGN PATENT DOCUMENTS

| | | | |
|---|---|---|---|
| DE | 202018107353 | U1 | 2/2019 |
| EP | 3354586 | A1 | 8/2018 |

* cited by examiner

MOUNTING RING FOR A TRANSPORT CONTAINER AND TRANSPORT CONTAINER

This application claims priority to German Patent Application No. 10 2019 116 227.0 filed on Jun. 14, 2019, which is hereby incorporated herein by reference.

The invention relates to a mounting ring for a transport container and a transport container which is provided for the transport of goods.

A transport container is known from DE 10 2015 105 030 B3, which is designed as a collapsible container. This container consists of a base, a lid and a mounting ring arranged between them, which is formed by four side walls, for example. For a return transport of such transport containers after the delivery of the goods, the mounting ring can be folded up and placed on the base, such that the lid subsequently rests on the base with interposition of the mounting ring.

Furthermore, transport containers are known in which such mounting rings are designed in two or more parts and divided into ring sections. In this way, for example, a ring section comprising a front side wall and a side wall section can be removed, wherein a further ring section comprising at least the rear wall can remain placed on the base in order to protect the goods stored on the base. Nevertheless, the goods can be accessed from the front. The ring sections forming the mounting ring are connected to each other with Velcro fasteners.

The invention is based on the object of proposing a mounting ring for a transport container and a transport container which enables a simple construction of the mounting ring and a simple transfer to a position for use for unloading goods or cargo.

This object is solved by a mounting ring for a transport container, in which the at least two ring sections, which form a closed mounting ring, have, at the respective end of the ring sections, a front edge which extends between an upper and lower front surface of the ring sections and can be connected to one another by a retaining profile, wherein the main profile receives the opposing front edges of the two adjacent ring sections and aligns them with one another. The retaining profile can easily be placed on a front edge of the one ring section and this ring section can be positioned on the base. Subsequently, the front edge of the other ring section can also be connected to the retaining profile and placed on the base. In this way, a closed mounting ring can be created in a simple way by putting together the at least two ring sections. The same applies to the removal of the one ring section from the other ring section. Short assembly and disassembly times are thus enabled.

Preferably, the retaining profile has a first U-shaped receptacle and a second U-shaped receptacle opposite it, which are aligned along a common outer leg. This allows the outer sides of the side wall sections of the ring section to be aligned with each other when the respective adjacent front edges of the side sections of the ring section are inserted into the retaining profile. In addition, only a small projection over the outer sides of the side wall sections can be achieved by the outer outside leg. This allows the mounting ring formed by the ring sections to be inserted together with the retaining profile into a groove in the floor and secured therein.

In addition, a latching element, preferably a latching lug, pointing into the U-shaped recess is preferably provided, which can be provided to be locked with a [lacuna] on the front edge of the side wall section of the ring section. This means that the retaining profile can be held on a ring section by a plug-in latching connection. Opposite, the U-shaped receptacle of the retaining profile can only be designed as a plug-in connection with the front edge of the adjacent ring section.

Furthermore, at least one side wall section and/or the side wall of the ring section is preferably made of a multi-layer plate, in particular a hollow chamber plate or three-layer plate, and the front edge is reduced in thickness compared to the thickness of the side wall section and/or the side wall. In this way, a connection point can be created with the retaining profile which only corresponds to the thickness of the side wall or only slightly protrudes on one side compared to an inner side or outer side of the side wall sections or side walls. The ring sections can be formed from so-called hollow chamber plates of triplex plates, which have a high stiffness. This means that the load capacity can be increased even when the transport containers are stacked one on top of the other.

Furthermore, the front edge of the side wall section is preferably formed by heat forming and the front edge is aligned centrally to the thickness of the side wall section or is aligned to the outside of the side wall section, such that a wall section of the front edge lies in the extension of a flat section of the side wall. This allows for inexpensive manufacturing while maintaining a closed side wall, in particular when using so-called hollow chamber plates.

Furthermore, the U-shaped receptacle of the retaining profile with the latching element preferably has a width that corresponds to the wall thickness of the front edge. This allows an exact receiving and arrangement of the retaining profile on the one ring section.

In addition, the U-shaped receptacle, which is opposite the receptacle with the latching element, has a width that is greater than the wall thickness of the front edges. This makes it easy to thread or insert the front edges into the hollow profile. Preferably, the width of this U-shaped receptacle corresponds to twice the thickness of the front edge.

Furthermore, the width of the U-shaped receptacles of the retaining profile is preferably narrower than the thickness of the side wall sections. This means that an inner volume of the transport container can be formed exclusively by the inner surfaces of the ring sections, and the retaining profile does not protrude into the inner space opposite these inner surfaces.

In addition, the inner legs of the U-shaped receptacle of the retaining profile have a length that corresponds to the width of the wall section of the front edge, which is reduced in thickness compared to the side wall sections, or is shorter. This means that, with the same length of the inner leg and width of the wall section of the front edge, an additional support of the side wall section on the inner legs of the U-shaped receptacle can occur.

Advantageously, one ring section of the mounting ring is designed as a so-called U-ring, which comprises a back wall and a side wall section adjacent to each side wall, which are preferably connected to the back wall in one piece by hinges. Such a U-ring can easily be folded up. It can also be placed on a base, in particular in a groove in the base.

Furthermore, the at least one further ring section is designed as a so-called C-ring, which has a front side wall and a side wall section laterally adjacent to it in each case, which are connected to the front side wall by a hinge, preferably in one piece. The C-ring differs from the U-ring in that the side wall sections of the C-ring are preferably shorter than those of the U-ring. By way of example, the width of the side wall sections of the C-ring is one third of the length of a side wall, and the side wall sections of the U-ring comprise two thirds of the corresponding side wall. Preferably, the two side wall sections have the same configuration.

This means that, in the case of a mounting ring made of two ring sections, the connecting points are in one plane, and the ring sections can be sprayed onto the base without any particular alignment.

A latching element, in particular a recess, is preferably provided at the respective front edge of the U-ring, such that the retaining profile with the U-shaped receptacle, which has the latching element, is held by a plug-in/latching connection. The respective front edges of the C-ring are preferably free of latching elements. These form only one plug-in connection with the U-shaped receptacle of the retaining profile. This means that the retaining profile can remain on the U-ring during assembly or disassembly of the mounting ring. This has a simplified handling. On the one hand, the C-ring can thereby be removed in a simple manner, wherein the U-ring remains on the base to protect the goods or cargo still stored on the base of the transport container for a successive removal. On the other hand, a simple handling can be enabled in this way in order to separate ring sections from each other, in order to thereupon fold them up for a return transport.

The object underlying the invention is further solved by a retaining profile for a mounting ring which comprises at least two ring sections, which comprises the features relating to the retaining profile in accordance with one or more of the above embodiments.

The object underlying the invention is further solved by means of a transport container having a base and a lid and a mounting ring made of at least two ring sections arranged in between, wherein the mounting ring is formed according to one of the above-described embodiments. Advantageously, the base and/or the lid is also made of plastic.

Figure 2:
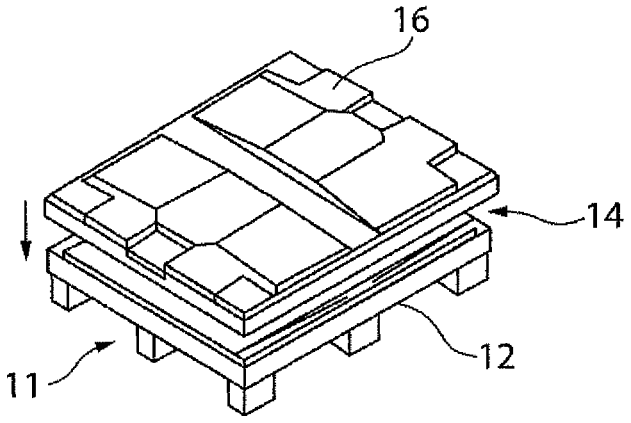
Figure 3:
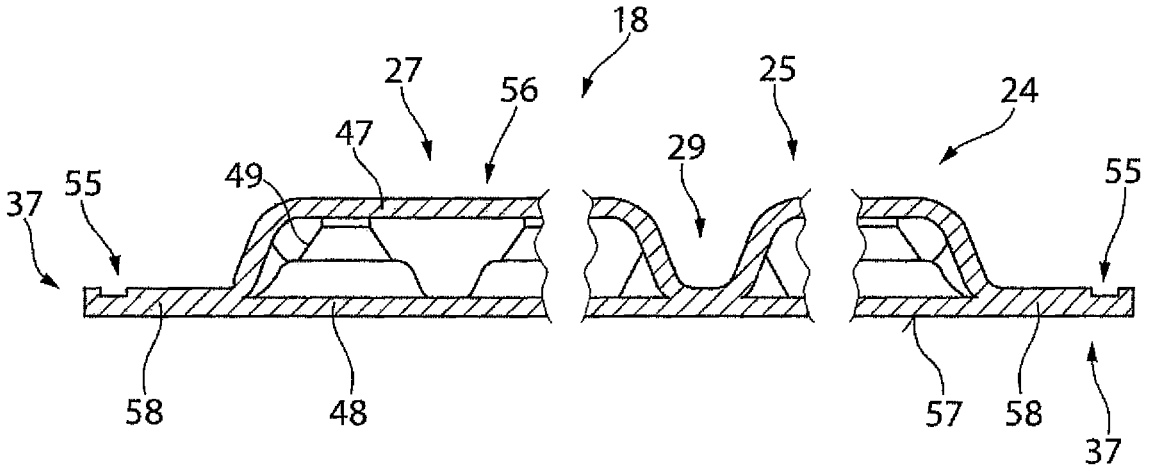
Figure 4:
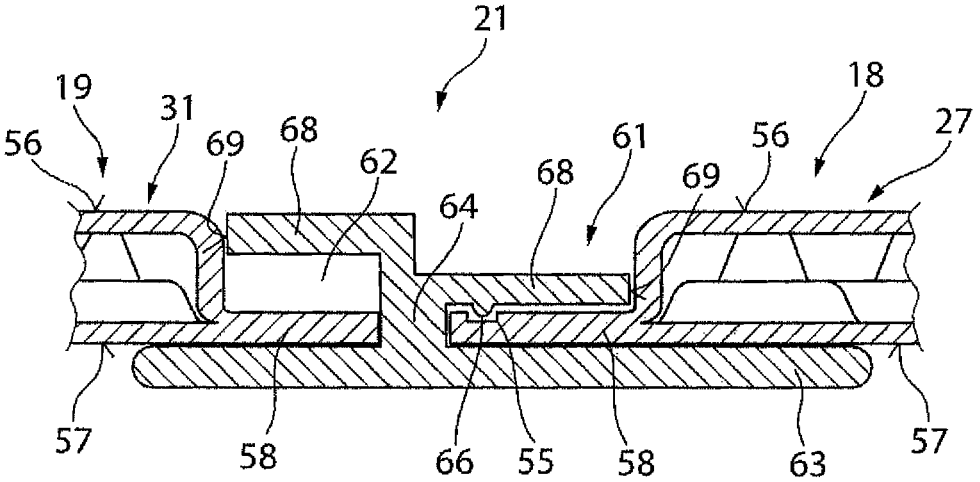

The invention and other advantageous embodiments and developments of the same are described and explained in more detail below using the examples depicted in the drawings. The features to be taken from the description and the drawings can be applied individually or in any combination in accordance with the invention. Here are shown:

FIG. 1 a perspective view of a transport container,

FIG. 2 a perspective view of the transport container according to FIG. 1 for a return transport, FIG. 3 a schematic sectional view of a ring section for a mounting ring of the transport container according to FIG. 1, and FIG. 4 a schematic sectional view along the line IV-IV in FIG. 1.

In FIG. 1, a perspective view of a transport container 11 is depicted. This transport container 11 consists of a base 12, a mounting ring 14, which comprises several side walls 15, and a lid 16 which can be placed on the mounting ring 14. On the base 12, a circumferential groove or recess 17 is provided along the outer edge region, which serves to receive and position the mounting ring 14. A circumferential recess is provided on the underside of the lid 16 such that the lid 16 rests securely on the mounting ring 14.

The mounting ring 14 comprises ring sections 18, 19. In the exemplary embodiment, the mounting ring 14 consists of two ring sections 18, 19. A connection point 22 is formed between the two ring sections 18, 19. The ring sections 18, 19 are connected to each other in the connection point 22 in each case by a retaining profile 21. Alternatively, the mounting ring 14 can also be made up of several ring sections 18, 19.

To transfer the transport container 11 for a return transport, the lid 16 is first lifted, the ring sections 18, 19 are separated and folded together. These folded ring sections 18, 19 are then placed on the base 12. Subsequently, the lid 16 is positioned on top of them. This allows a small transport volume for the return transport, as is depicted in FIG. 2.

The mounting ring 14 comprises the first and second ring section 18, 19. The connection point 22 is provided, for example, in a left and right side wall 23, 24. Alternatively or additionally, a connection point 22 can also be in a back wall 25 or a front side wall 26.

The first ring section 18 comprises, according to the exemplary embodiment, the back wall 25 and a right and left side wall section 27, 28. These side wall sections 27, 28 are preferably connected to the back wall 25 in one piece by a hinge 29. The hinge 29 can be introduced by stamping or heat forming.

The ring section 19 comprises the front side wall 26 and right and left side wall sections 31, 32 arranged laterally thereon in each case, which are preferably connected in one piece to the front side wall 26 by means of a hinge 29. The right side wall sections 27, 31 and the left side wall sections 28, 32 correspond in their size to the side walls 23, 24 with the interposition of the retaining profile 21 at the connection point 22.

The right and left side wall sections 27, 28 of the first ring section 18 are wider than the right and left side wall sections 31, 32 of the front ring section 19. The ring sections 18, 19 have a common upper front surface 33 and a lower front surface 34. The mounting ring 14 rests with the lower front surface 34 in the recess 17 in the base 12. The lid 16 rests with its recess on the upper front surface 33 of the mounting ring 14.

In FIG. 3, a schematic sectional view along the ring section 18 in an unfolded position is depicted. This ring section 18 comprises the back wall 25 and the two right and left side wall sections 27, 28, each connected by the hinge 29, wherein one of the two hinges 29 is not depicted. The side wall 15 and the side wall sections 23, 24 consist of two outer plastic layers 47, 48, for example, between which a third plastic layer 49 is formed. This can be bubble wrap or similar, which has elevations or depressions on one or both sides. These plastic layers 47, 48, 49 are welded together. The stamped sections 18 have a front edge 37 at each edge. This front edge 37 extends between the upper and lower front surfaces 33, 34 of the ring sections 18, 19. This front edge 37 is tapered in terms of its wall thickness compared to the side wall 15 and the side wall sections 27, 28. The front surface 37 can be produced by heat forming by pressing the outer plastic layers 47, 48 together. This creates a wall section 58 which is formed to be rigid and closes the side wall 15 and the side wall sections 26, 27. The wall strength of the wall section 58 is determined by the strength of the plastic layers 47, 48, 49 and the pressing force. Preferably, one outer side of the front edge 37 is aligned flush with the outer side 57 of the side wall 15 or the side wall sections 27, 28. A latching element 55 is provided on the front edge 37. This latching element 55 is designed as a recess, for example. The latching element 55 is provided on the wall section 58 opposite the outer side 57. Such a latching element 55 can occur simultaneously during the production of the front edge 37. The latching element 55 is adapted to the shape and/or contour of another latching element 66 in the retaining profile 21.

The side wall 15 and the right and left side wall sections 27, 28 are connected by the hinge 29. This in turn can be produced by heat forming, which makes it possible for the side wall sections 26, 27 to be pivoted or folded towards the side wall 15.

The ring section 18 has the latching element 55 at the respective end of the right and left side wall section 27, 28, said latching element preferably facing the inside after being placed on the base 12.

The structure of the ring section 19 preferably corresponds to that of the ring section 18. The ring section 19 differs from the ring section 18 in that no latching element 55 is introduced at the front edge 37. Furthermore, the ring section 19 can differ from the ring section 18 in that the right and left side wall sections 31, 32 are narrower than the side wall sections 27, 28 of the ring section 18.

In FIG. 4, a schematic sectional view along the line IV-IV in FIG. 1 is depicted. This sectional view shows the connection point 22 with the retaining profile 21 and the two ring sections 18, 19 arranged adjacent to each other. By means of the retaining profile 21, the right side wall section 27 of the ring section 18 is connected to the right side wall section 31 of the ring section 19. This forms a closed side wall 15.

The retaining profile 21 has two opposing U-shaped receptacles 61, 62. These two U-shaped receptacles 61, 62 extend along a common outer leg 63. The two U-shaped receptacles 61, 62 are separated from each other by a common web 64. This web 64 forms a base for each of the U-shaped receptacles 61, 62, which are aligned opposite each other. The receptacle 61 comprises a latching element 66 pointing towards the inside of the receptacle 61, which is designed as a projection, for example. This latching element 66 forms a plug-in/latching connection with the latching element 55 on the front edge 37. The width of the U-shaped receptacle 61 is preferably adapted to the wall thickness of the wall section of the front edge 37. An inner leg 68 of the U-shaped receptacle 61 has a length which preferably corresponds to the width of the wall section 58. This means that an outwardly directed end surface 69 of the inner leg 68 can be set back in relation to an inner wall surface of the side wall section 27 and/or the side wall 15. In addition, the front surface 69 can support itself in the transition region between the front edge 37 and the non-tapered flat section 56 of the side wall 15.

The outer leg 63 is longer than the inner leg 68 in the region of the U-shaped receptacle 61.

The second U-shaped receptacle 62 is wider than the first U-shaped receptacle 61. The second U-shaped receptacle 62 is preferably twice as wide as the first U-shaped receptacle 61.

The inner leg 68 of the second U-shaped receptacle 62 preferably runs flush with the inside of the flat section 56 of the side wall section 31 or is set back opposite this. Advantageously, a front surface 69 of the inner leg 68 of the second U-shaped receptacle 62 can also support itself in the transition region between the front edge 37 and the flat section 56 of the right side wall section 31. The outer leg 63 in the case of the second U-shaped receptacle 62 is longer than the inner leg 68.

This arrangement enables a plug-in/latching connection to be created between the retaining profile 21 and the ring section 18, such that the retaining profile 21 remains on the ring section 18 during normal use. The ring section 19 can be connected to the retaining profile 21 by a plug-in connection. For easier formation of this plug-in connection, the U-shaped receiving section 62 is therefore wider than the front edge 37 of the right side wall section 31.

The above embodiments apply analogously to the retaining profile 21, which connects a left side wall section 28 of the ring section 18 with a left side wall section 32 of the ring section 19. It is significant that a plug-in/latching connection is formed between the retaining profile 21 and one of the ring sections 18, and only one plug-in connection is formed with the opposite ring section 19.

The retaining profile 21 extends completely along the front edge 37 of the first and second ring section 18, 19.

The retaining profile 21 is preferably designed as an extruded/pressing profile or extrusion profile made of plastic.

The invention claimed is:

1. A mounting ring for a transport container which is arrangeable between a base and a lid of the transport container, having at least two ring sections which form a closed mounting ring having several side walls, wherein each ring section comprises at least one side wall section, each at least one side wall section having an upper and lower front surface and a front edge extending at an end of the ring section between the upper and lower front surface, wherein a connection point is provided, the connection point comprising a retaining profile and the respective front edges arranged adjacent to each other, the retaining profile having a first U-shaped receptacle and a second U-shaped receptacle, wherein the respective front edges are connected to the retaining profile to form a common side wall, wherein each of the first and second U-shaped receptacles has an inner leg, an outer leg, and a portion of a common web interconnecting the inner and outer legs, wherein the first and second U-shaped receptacles are aligned such that the respective outer legs together form a common outer leg of the retaining profile, and wherein the respective inner legs of the first and second U-shaped receptacles have a length which corresponds to or is shorter than a width of a wall section of the respective front edges.

2. The mounting ring according to claim 1, wherein the first U-shaped receptacle has a latching element pointing into the U-shaped receptacle, said latching element being lockable to a latching element arranged on the front edge of the corresponding at least one side wall section.

3. The mounting ring according to claim 1, wherein each at least one side wall section includes a multilayer plate, and a thickness of the front edge is reduced in relation to the thickness of the corresponding at least one side wall section and/or side wall.

4. The mounting ring according to claim 3, wherein each front edge is formed by heat forming, and each front edge is aligned centrally to the thickness of the corresponding at least one side wall section, or is aligned towards the outer side of the corresponding at least one side wall section, such that a wall section of each front edge lies in the extension of a flat section of the corresponding at least one side wall section.

5. The mounting ring according to claim 4, wherein the respective front edges aligned with the outer sides of the respective at least one side wall sections is aligned with the outer side at the respective end of the at least two ring sections.

6. The mounting ring according to claim 2, wherein the first U-shaped receptacle with the latching element has a width which corresponds to the wall thickness of the corresponding front edge.

7. The mounting ring according to claim 2, wherein the second U-shaped receptacle, which is formed without a latching element, has a width which is greater than the wall thickness of the corresponding front edge.

8. The mounting ring according to claim 1, wherein the respective width of the first or second U-shaped receptacle is narrower than the thickness of the corresponding at least one side wall section at the respective end of the at least two ring sections.

9. The mounting ring according to claim 1, wherein one of the at least two ring sections is formed as a U-ring which comprises a back wall and side wall portions each of the side wall portions being connected to the back wall by a hinge, and wherein another one of the at least two ring sections is formed as a C-ring having a front side wall and at least one side wall section arranged thereon, wherein the at least one side wall of the C-ring is shorter than least one of the side wall portions of the U-ring.

10. The mounting ring according to claim 9, wherein respective latching elements are provided on the respective front edges of the U-ring, and the retaining profile is held on the U-ring by means of the plug-in/latching connection.

11. The mounting ring according to claim 9, wherein the respective front edges of the C-ring form only one plug-in connection with the retaining profile.

12. A transport container having a base, having a lid and having the mounting ring according to claim 1 arranged therebetween made of the at least two ring sections, wherein the at least two ring sections are placeable on the base and the lid is placeable on the at least two ring sections.

13. The mounting ring according to claim 2, wherein the latching element is a latching lug.

14. The mounting ring according to claim 3, wherein the multilayer plate is a hollow chamber plate or three layer plate.

15. The mounting ring according to claim 2, wherein the second U-shaped receptacle, which is formed without a latching element, has a width, which corresponds to twice the wall thickness of the front edge.

* * * * *